US011618121B2

(12) United States Patent
Klacking

(10) Patent No.: US 11,618,121 B2
(45) Date of Patent: Apr. 4, 2023

(54) ASSEMBLY FOR A FLOOR PROCESSING MACHINE

(71) Applicant: SlurryMonster, LLC, Livonia, MI (US)

(72) Inventor: Ryan Klacking, Canton, MI (US)

(73) Assignee: Slurrymonster, LLC, Livonia, MI (US)

( * ) Notice: Subject to any disclaimer, the term of this patent is extended or adjusted under 35 U.S.C. 154(b) by 0 days.

(21) Appl. No.: 17/358,670

(22) Filed: Jun. 25, 2021

(65) Prior Publication Data

US 2022/0088739 A1 Mar. 24, 2022

Related U.S. Application Data

(60) Provisional application No. 63/149,838, filed on Feb. 16, 2021, provisional application No. 63/082,047, filed on Sep. 23, 2020.

(51) Int. Cl.

| | |
|---|---|
| ***B24B 7/18*** | (2006.01) |
| ***B24B 23/02*** | (2006.01) |
| ***B24B 55/10*** | (2006.01) |
| ***B24B 41/02*** | (2006.01) |
| ***B27M 3/04*** | (2006.01) |

(52) U.S. Cl.

CPC ..... *B24B 7/18* (2013.01); *B24B 23/02* (2013.01); *B24B 23/024* (2013.01); *B24B 41/02* (2013.01); *B24B 55/102* (2013.01); *B27M 3/04* (2013.01)

(58) Field of Classification Search

CPC ..... B24B 7/18; B24B 7/186; B24B 7/188; B24B 23/00; B24B 23/005; B24B 23/02; B24B 23/024; B24B 55/10; B24B 55/102; B24B 55/04; B24B 55/05; B24B 55/052

USPC ..... 451/350, 351, 352, 353, 451, 456

See application file for complete search history.

(56) References Cited

U.S. PATENT DOCUMENTS

| | | | | |
|---|---|---|---|---|
| 5,584,598 | A * | 12/1996 | Watanabe | E04F 21/245 404/112 |
| 5,816,740 | A * | 10/1998 | Jaszkowiak | E04F 21/247 404/112 |
| 6,238,277 | B1 * | 5/2001 | Duncan | A47L 11/16 451/271 |
| 6,592,290 | B2 * | 7/2003 | Jaszkowiak | E04F 21/247 404/112 |
| 6,783,447 | B2 * | 8/2004 | Van Vliet | A47L 11/164 451/353 |
| 7,815,393 | B2 * | 10/2010 | Snyder | E04F 21/248 404/112 |
| 8,585,466 | B2 | 11/2013 | Van Eijden et al. | |
| 8,684,796 | B2 * | 4/2014 | McCutchen | B24B 7/186 451/57 |
| 9,068,300 | B2 * | 6/2015 | Fielder | E04F 21/24 |

(Continued)

OTHER PUBLICATIONS

MultiQuip Parts Manual—Whiteman Model LD6 Hydraulic Ride-On Trowel Revision #1 Dec. 4, 2020. 66 pages. available at www.multiqup.com.

*Primary Examiner* — Eileen P Morgan

(74) *Attorney, Agent, or Firm* — Carlson, Gaskey & Olds, P.C.

(57) ABSTRACT

An enclosure assembly includes a pan that includes at least one shaft opening. A shroud at least partially surrounds the pan. The shroud extends transversely relative to the pan. A skirt surrounds a perimeter of the shroud and is moveable relative to the shroud.

21 Claims, 14 Drawing Sheets

(56) References Cited

U.S. PATENT DOCUMENTS

| | | | | |
|---|---|---|---|---|
| 10,702,054 | B2 * | 7/2020 | Rudolph | A47L 11/161 |
| 2007/0232206 | A1 | 10/2007 | Shorrock et al. | |
| 2008/0201877 | A1 * | 8/2008 | Sengewald | A47L 11/4075 15/4 |
| 2009/0190999 | A1 * | 7/2009 | Copoulos | B24B 41/047 404/112 |
| 2012/0279010 | A1 * | 11/2012 | Kenter | A47L 11/4083 15/320 |
| 2018/0193977 | A1 | 7/2018 | Clay | |
| 2019/0160622 | A1 * | 5/2019 | Barth | B24B 55/10 |
| 2019/0270173 | A1 * | 9/2019 | Fogelberg | B24B 41/047 |
| 2019/0343363 | A1 * | 11/2019 | Stuchlik | A47L 11/305 |
| 2020/0346315 | A1 * | 11/2020 | Persson | B24B 7/186 |
| 2021/0260714 | A1 * | 8/2021 | Lagerwaard | A47L 11/4069 |

* cited by examiner

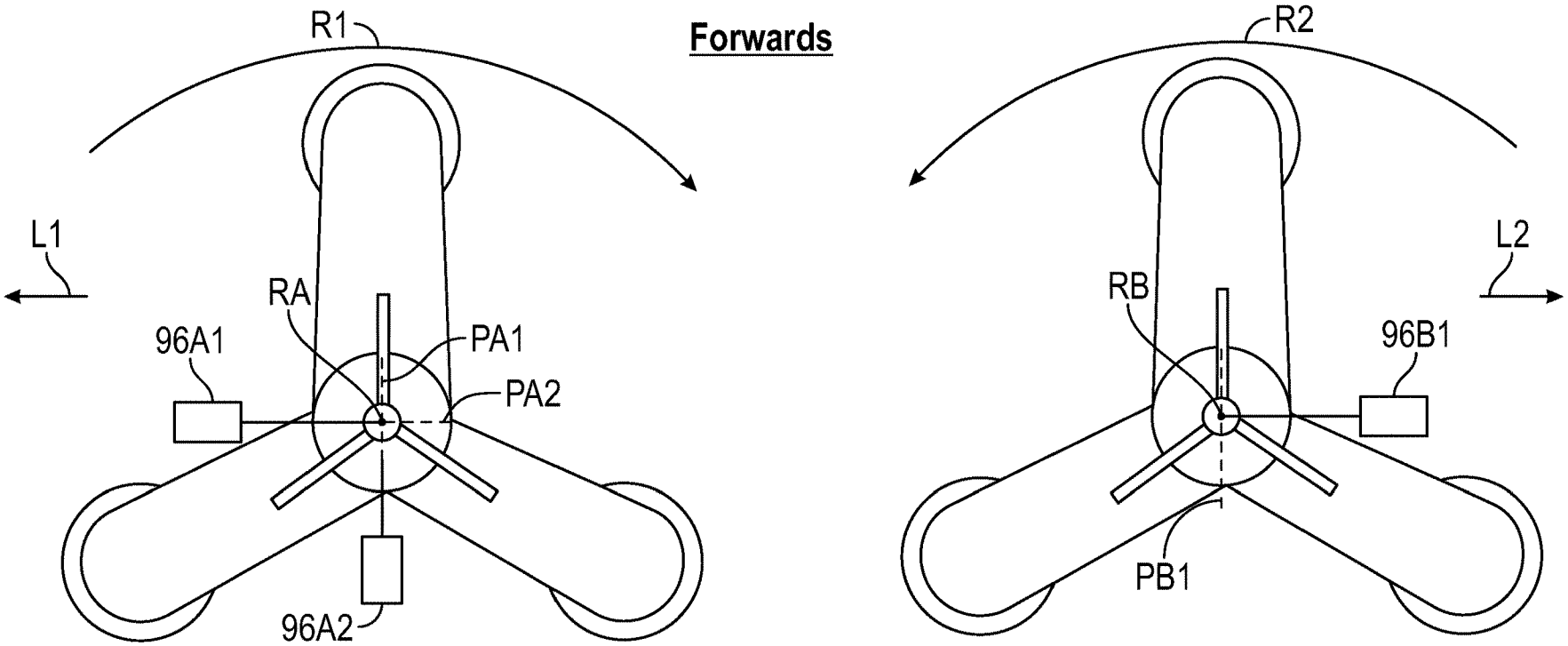
FIG. 17
FIG. 17
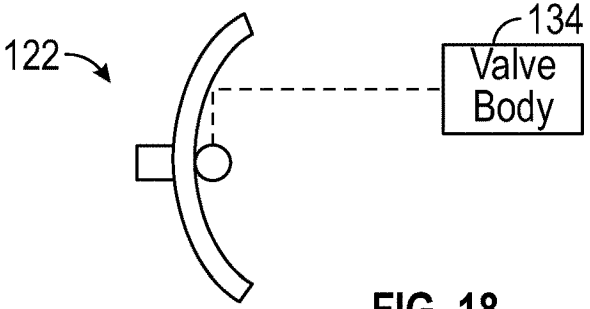
FIG. 18

ASSEMBLY FOR A FLOOR PROCESSING MACHINE

REFERENCE TO RELATED APPLICATIONS

This application claims the benefit of U.S. Provisional Application No. 63/082,047 filed Sep. 23, 2020 and U.S. Provisional Application No. 63/149,838 filed Feb. 16, 2021, the disclosures of which are incorporated entirely by reference.

BACKGROUND

The present disclosure relates to processing a floor surface, and more particularly, to processing a floor surface with a tool head on a rotational machine.

Traditionally, a variety of machines have been used to prepare or finish a surface. In the case of curing concrete, a trowel machine has been used. Trowel machines generally include at least one rotor having a plurality of arms with blades attached to distal ends of the arms that engage the floor surface. The arms may be rotatably attached to a central hub to change a pitch of the blades.

SUMMARY

In one exemplary embodiment, an enclosure assembly includes a pan that includes at least one shaft opening. A shroud at least partially surrounds the pan. The shroud extends transversely relative to the pan. A skirt surrounds a perimeter of the shroud and is moveable relative to the shroud.

In another embodiment according to any of the previous embodiments, the shroud directly engages the pan and forms a seal with the pan.

In another embodiment according to any of the previous embodiments, the pan includes at least one shaft opening for accepting a rotor drive shaft.

In another embodiment according to any of the previous embodiments, a flexible boot at least partially encloses the at least one shaft opening in the pan and has a rotor shaft opening for accepting the rotor shaft.

In another embodiment according to any of the previous embodiments, a first bearing engages a first side of the flexible boot.

In another embodiment according to any of the previous embodiments, the first bearing includes an outer race that is fixed relative to the flexible boot. An inner race is configured to rotate with the rotor shaft.

In another embodiment according to any of the previous embodiments, a second bearing engages a second side of the flexible boot.

In another embodiment according to any of the previous embodiments, the second bearing includes an outer race that is fixed relative to the flexible boot and an inner race configured to rotate with the rotor shaft.

In another embodiment according to any of the previous embodiments, the skirt is made of a polymeric based material.

In another embodiment according to any of the previous embodiments, at least one fluid nozzle is directed into the enclosure and is in fluid communication with a liquid line.

In another exemplary embodiment, an assembly for a floor surface processing machine includes at least one rotor which includes a floor engagement tool. A frame at least partially surrounds the at least one rotor. An enclosure at least partially surrounds the at least one rotor. The enclosure includes a pan which includes at least one shaft opening for accepting a drive shaft for the at least one rotor. A shroud at least partially surrounds the pan and extends transversely relative to the pan. A skirt surrounds a perimeter of the shroud and is moveable relative to the shroud.

In another embodiment according to any of the previous embodiments, a water line fitting is surrounded by a rotatable hose connection. The rotatable hose connection includes a diameter larger than a diameter of the water line fitting.

In another embodiment according to any of the previous embodiments, an intersection of the shroud and the pan forms a sealed connection.

In another embodiment according to any of the previous embodiments, the pan includes at least one shaft opening for accepting a rotor drive shaft. The pan extends in a plane generally parallel with a plane of the floor surface.

In another embodiment according to any of the previous embodiments, a flexible boot at least partially encloses the at least one shaft opening in the pan and has a rotor shaft opening for accepting the rotor shaft.

In another embodiment according to any of the previous embodiments, a first bearing engages a first side of the flexible boot. The first bearing includes an outer race fixed relative to the flexible boot. An inner race is configured to rotate with the rotor shaft.

In another embodiment according to any of the previous embodiments, a second bearing engages a second side of the flexible boot. The second bearing includes an outer race fixed relative to the flexible boot and an inner race configured to rotate with the rotor shaft.

In another exemplary embodiment, a method of collecting debris with a floor processing machine includes processing a floor surface with at least one rotor located in an enclosure to generate debris within the enclosure. A liquid is injected into the enclosure with at least one nozzle located within the enclosure while processing the floor surface. A slurry formed when the debris mixes with the liquid is collected with a floor collection device attached to the floor processing machine.

In another embodiment according to any of the previous embodiments, the floor collection device includes at least one squeegee that has an arcuate shape for collecting the slurry in a central portion of the squeegee and extracting the slurry from the central portion of the squeegee with a suction line.

In another embodiment according to any of the previous embodiments, the at least one squeegee includes a first squeegee attached to a frame of the floor processing machine. A second squeegee is attached to the frame of the floor processing machine. The first squeegee and the second squeegee are actuatable into and out of contact with the floor surface depending on a direction of movement of the floor processing machine.

BRIEF DESCRIPTION OF THE DRAWINGS

The various features and advantages of the present disclosure will become apparent to those skilled in the art from the following detailed description. The drawings that accompany the detailed description can be briefly described as follows.

FIG. 17 schematically illustrates operation of the floor processing machine.

FIG. 18 illustrates a top view of a squeegee.

DETAILED DESCRIPTION

Figure 1:
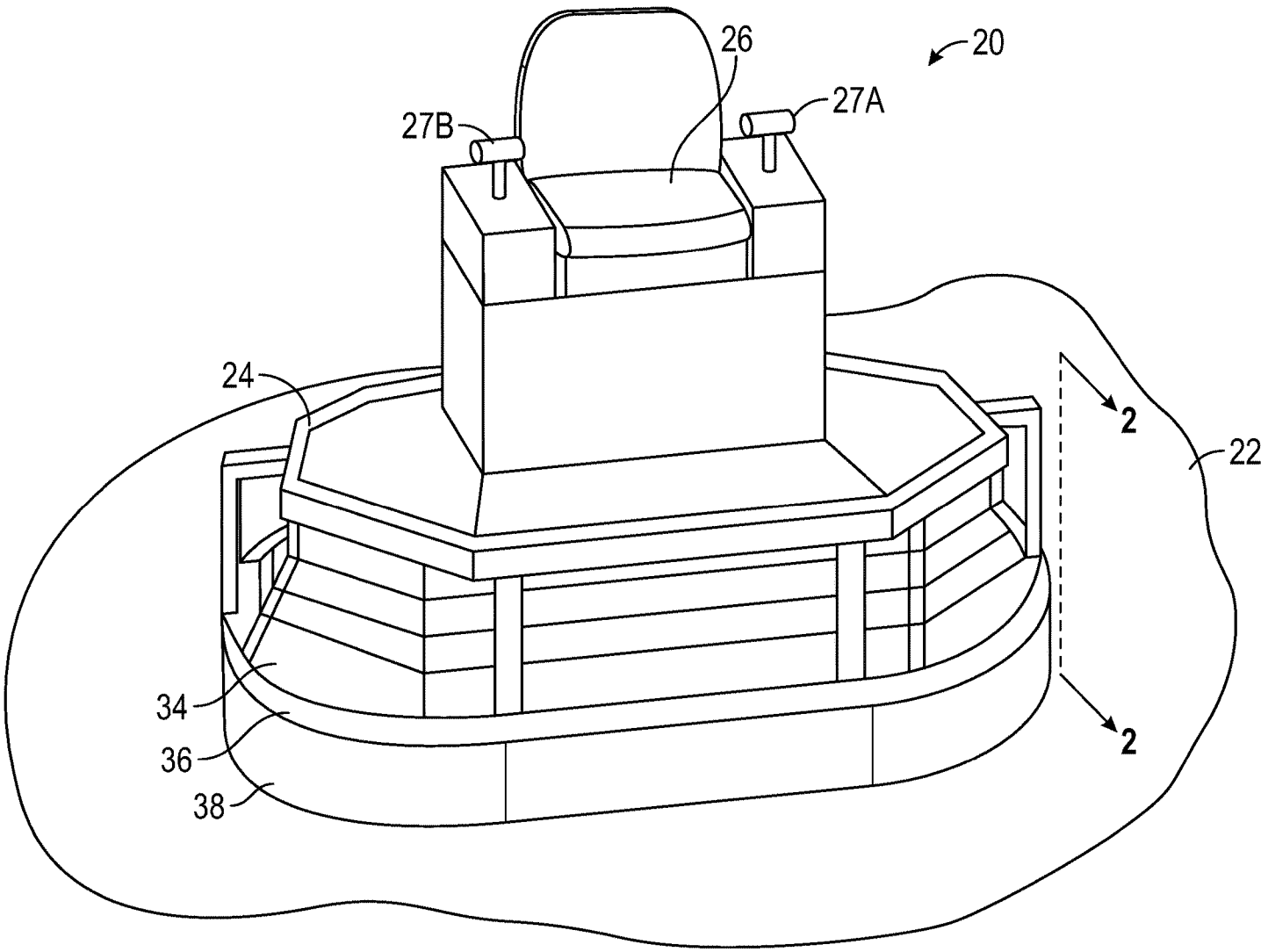
FIG. 1 illustrates a perspective view of an example floor processing machine.

FIG. 1 illustrates an example floor processing machine 20 for engaging a floor surface 22. The machine 20 may process the floor surface 22 of cured concrete through one or more of a grinding process, a polishing process, or a honing process. If the floor surface 22 is wood, the machine 20 may perform a sanding process or a cleaning process and if the floor surface 22 is a VCT material, the machine 20 may perform a cleaning or striping process. The machine 20 may operate in either dry or wet conditions as described below. Troweling machines, as opposed to the machine 20, have traditionally been used to trowel a concrete surface as it cures and hardens to create a smooth and relatively flat surface. To perform this function, troweling machines utilize elongated blades on rotating arms with a curing concrete surface as opposed to the machine 20 which operates on cured concrete floors that are already hardened. Additionally, the arms on troweling machines are generally rotatably about a longitudinal axis of the arm to change a pitch of the elongated blades with respect to the floor surface.

Figure 2:
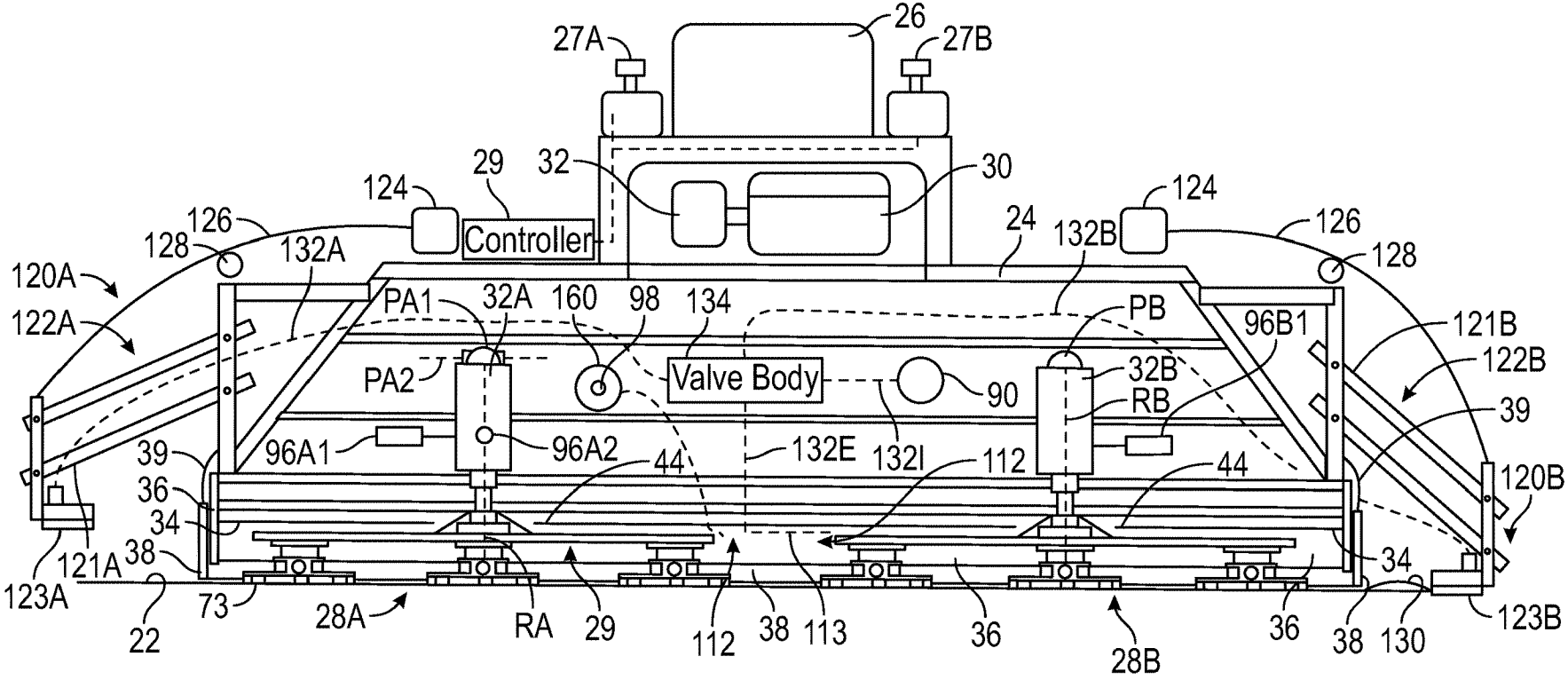
FIG. 2 illustrates a cross-sectional view of said floor processing machine along line 2-2 of FIG. 1.

As shown in FIGS. 1 and 2, the machine 20 includes a frame 24 that supports an operator seat 26 and at least partially surrounds a first rotor 28A and a second rotor 28B for engaging the floor surface 22. An engine 30 is supported by the frame 24 and is used to drive the first and second rotors 28A, 28B. In the illustrated example, the engine 30 drives a hydraulic pump 32 fluidly connected to hydraulic motors 32A, 32B for independently driving the first and second rotors 28A, 28B, respectively.

Additionally, the machine 20 hovers on the rotors 28A, 28B and does not rely on wheels for maneuvering on the floor surface 22 during operation. Rather, axes of rotation RA, RB for the first and second rotors 28A, 28B, respectively, are pivoted about pivot axes to allow the machine 20 to move forward, backward, laterally, or rotated on the floor surface 22 as will be described in greater detail below. From the operator seat 26, a user can operate a first joy stick 27A and/or a second joystick 27B both in electrical communication with a controller 29 on the machine 20 for controlling operation as described below.

Figure 3:
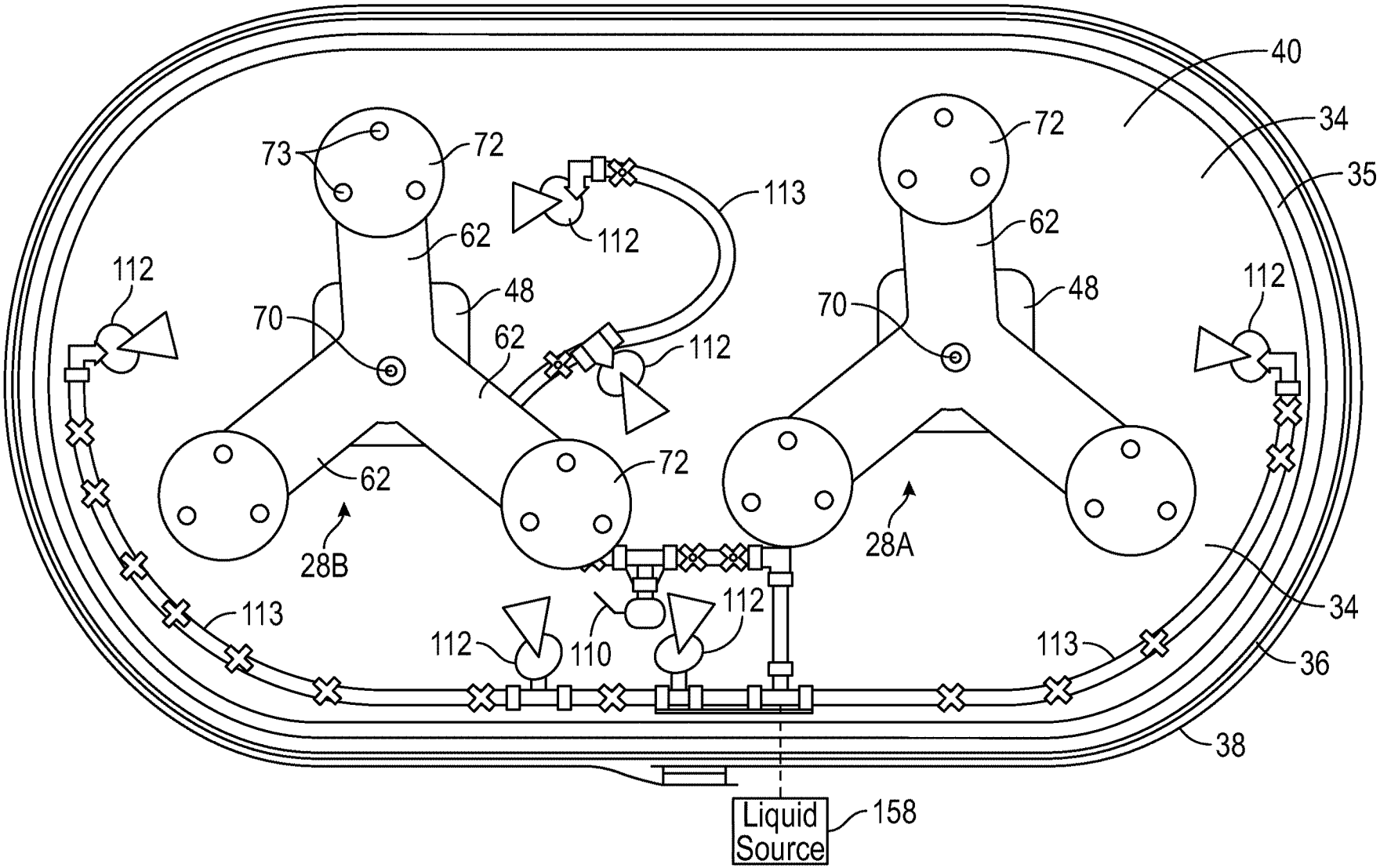
FIG. 3 illustrates a view of an enclosure on the floor processing machine of FIG. 1.

As shown in FIGS. 2 and 3, the first and second rotors 28A, 28B are located in an enclosure 40 at least partially defined by a pan 34, a shroud 36, and a skirt 38. The enclosure 40 reduces air leaks relative to the floor surface during operation of the machine 20 to separate the enclosure 40 from the surrounding environment. One feature of the enclosure 40 is improved management of debris generated through contact between the first and second rotors 28A, 28B and the floor surface 22.

The debris generated by the rotors 28A, 28B on the floor surface 22 may form airborne particles during dry operating conditions or a slurry during wet operating conditions. In this disclosure, a slurry is a material having solid particles suspended in a liquid, such as water. When the solid particles in the slurry are cementitious, the slurry can have a significant weight beyond that of the liquid and can require special handling procedures because of the pH of the material. Additionally, the formation of a slurry with prior art devices required a significant amount of water to be spread on the floor surface 22 during operation of a floor grinding machine to ensure that the particles are captured in the slurry prior to becoming airborne. As will be descried further below, one feature of the machine 20 is a reduction in water consumption when forming a slurry material on the floor surface 22.

In the illustrated example, the pan 34 forms an upper surface of the enclosure 40 relative to the floor surface 22 and is located on an opposite side of the rotors 28A, 28B from the floor surface 22. In this disclosure, upper and lower are relative to the machines normal operating position on the floor surface 22 unless stated otherwise. An opening 44 is located in the pan 34 to allow a separate shaft 46 from each of the hydraulic motors 32A, 32B to drive a corresponding one of the first and second rotors 28A, 28B, respectively.

The pan 34 may be formed from a single piece of material, such as aluminum or a polymer based material. Alternatively, the pan 34 may be formed from multiple panels sealed together to simplify the assembly or service process of the machine 20. Also, a majority of the pan 34 may extends in a single plane with a perimeter ledge 35 spaced from the single plane to follow a profile of a lower portion of the frame 24. One feature of the ledge 35 is to vary a position of the plan relative to the rotors 28A, 28B to allow for proper clearance depending on the configuration of the frame 24. Additionally, the pan 34 is positioned to provide sufficient clearance from the engine 30 and motors 32A, 32B and 96, to prevent the machine 20 from overheating. In particular, the placement of the enclosure 40 allows the frame 24 to remain open for airflow to cool the operating components of the machine 20 as opposed to forming the enclosure from within the entire frame 24.

Another feature of the enclosure 40 is improved debris management to protect electrical and/or mechanical components on the machine 20. In particular, the slurry and/or airborne particles can enter sensitive electrical and/or mechanical components on the machine 20 and reduce the serviceable life of the components. This is particularly true in the case of bearings, electrical connectors, motors, engines, and etc. Additionally, the improved debris management by the machine 20 reduces maintenance and will therefore allow the machine 20 to operate for longer periods of time compared to other machines. The reduction in maintenance and repairs also improves the profitability of the machine 20 as it can operate for longer periods of time without service or repair. Furthermore, not only does the enclosure 40 protect the machine 20, but it also protects the surrounding environment from slurry that splashes off of the first or second rotors 28A, 28B or particles that become airborne and could settle on surrounding surfaces. This reduces the amount of preparation needed on the environment surrounding the floor surface 22 before the machine 20 can begin processing the floor surface 22.

Figure 4:
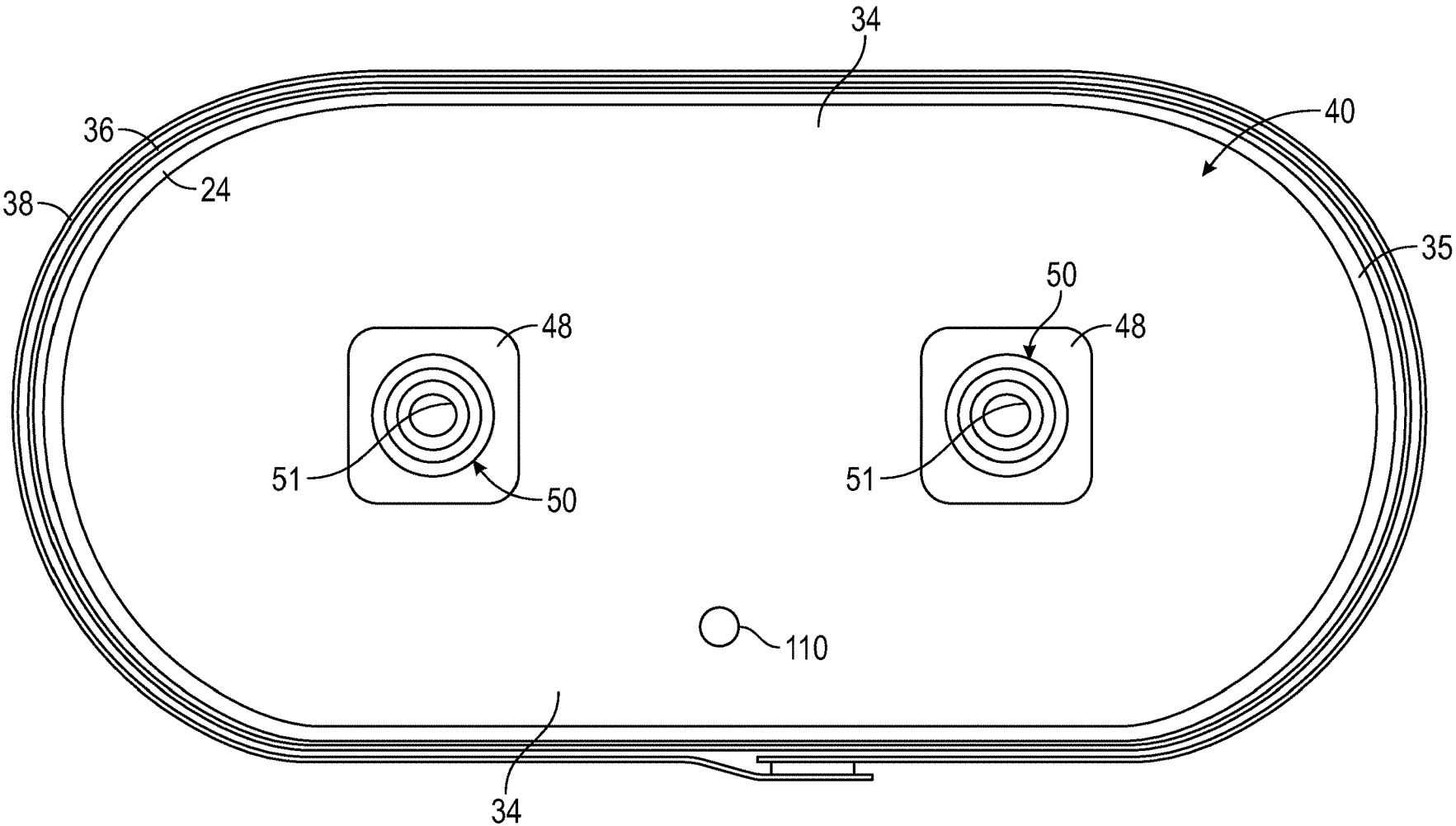
FIG. 4 illustrates another view of the enclosure of FIG. 3 without rotors or shafts.
Figure 5:
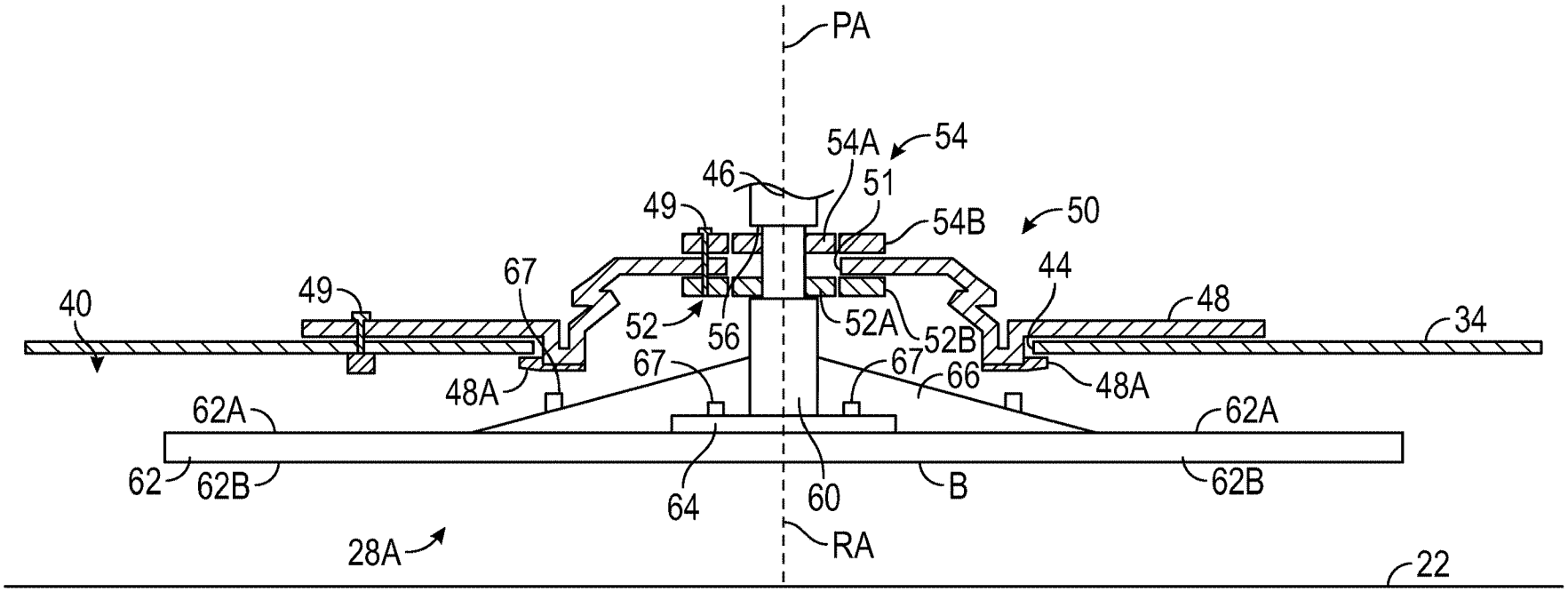
FIG. 5 illustrates an enlarged view of a rotor and shaft from FIG. 2 with a boot.

FIGS. 3-5 illustrate a boot 48 that creates a seal between one of the shafts 46 and the pan 34 to prevent debris from leaving the enclosure 40 through the opening 44 in the pan 34. The boot 48 is made from a flexible material, such as rubber or another polymeric material. The boot 48 may be attached to the pan 34 through a retention tab 48A on the boot 48 adjacent the opening 44 or through an adhesive or mechanical fastener 49, such as a bolt, screw, or rivet. In the illustrated example, the boot 48 includes a square perimeter that surrounds a circular bellows 50 having at least one undulation. The boot 48 also includes an opening 51 to allow one of the shafts 46 to communicate with a corresponding one of the first or second rotors 28A, 28B. One feature of the boot 48 with the bellows 50 is that it maintains a seal with a corresponding shaft 46 as it moves off of an axis of rotation R that is perpendicular to the floor surface 22 as will be described in greater detail below. However, the boot 48 could be conical in shape without the bellows 50 depending on an amount of movement the shaft 46 takes off of its axis of rotation R during operation.

The boot 48 is further sealed relative to the shaft 46 through a first bearing 52 and a second bearing 54 sandwiching a portion of the boot 48 around the opening 51. In the illustrated example, the first bearing 52 is located within the enclosure 40 and the second bearing 54 is located outside of the enclosure 40 and on an opposite side of the boot 48. Both the first and second bearings 52, 54, may be sealed bearings to prevent debris from entering during operation of the machine 20 and reducing a serviceable life of the bearing surfaces in the bearings 52, 54.

In the illustrated example, the first bearing 52 includes an inner race 52A that is fixed to and rotates with the shaft 46 and an outer race 52B that is fixed relative to the boot 48. Similarly, the second bearing 54 includes an inner race 54A that is fixed to and rotates with the shaft 46 and an outer race 54B that is fixed relative to the boot 48. The outer races 52B, 54B can frictionally engage the boot 48 or be attached by an adhesive or a mechanical fastener 49, such as a bolt, screw, or rivet.

Figure 6:
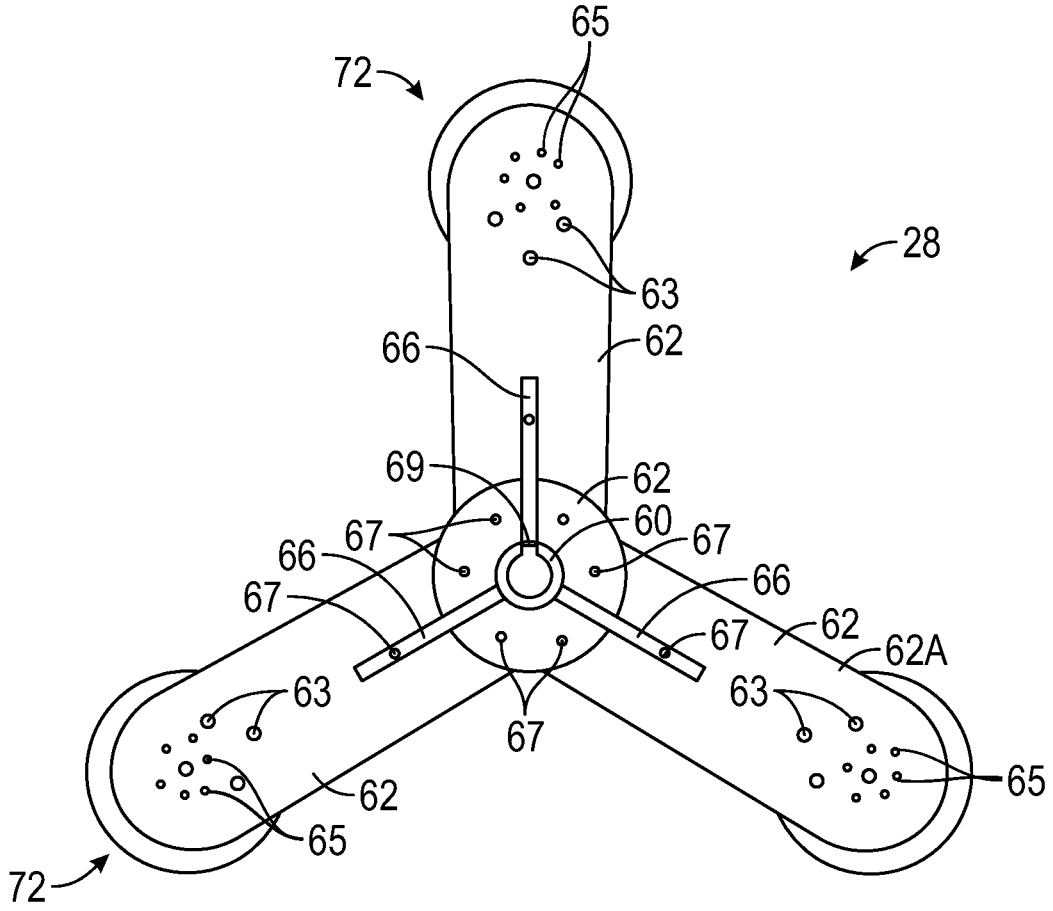
FIG. 6 illustrates a top view of a rotor.
Figure 7:
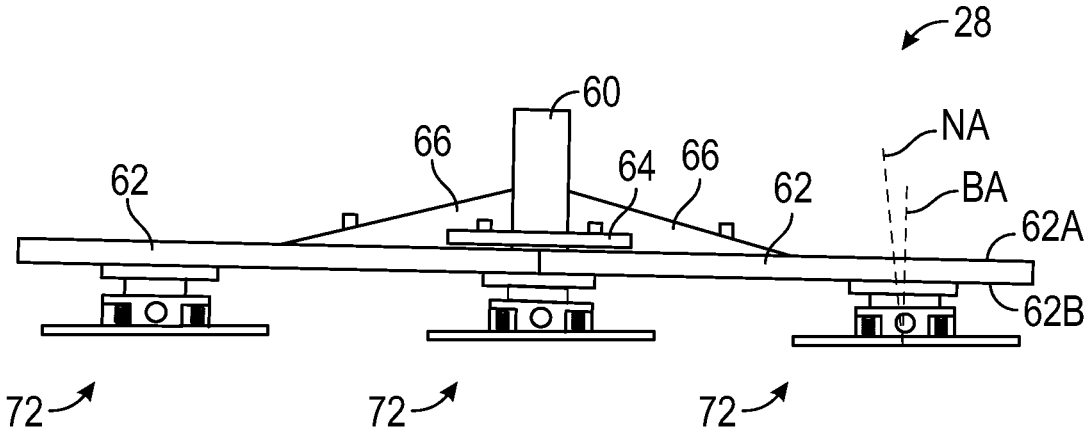
FIG. 7 illustrates a side view of the rotor of FIG. 6 in a flexed position.

As shown in FIGS. 5-7, the first and second rotors 28A and 28B each include a spindle 60 having a distal end that is adjacent to or in contact with the first bearing 52. In particular, the spindle 60 may engage only the inner race 52A of the first bearing 52 as the spindle 60 and the inner race 52A rotate together at the same rotational speed and in the same direction. Additionally, the shaft 46 includes a shoulder 56 adjacent the second bearing 54 that may engage the inner race 54A as the shoulder 56 and shaft 46 rotate together at the same rotational speed and in the same direction. A combination of the spindle 60 and the shoulder 56 contributes to sandwiching the boot 48 and creating a seal between the first and second bearings 52, 54 and the boot 48. This seal further improves the air tightness of the enclosure 40 to improve the ability to extract airborne particles from the enclosure 40 as described in greater detail below.

The rotors 28A, 28B each include the spindle 60, three arms 62 extending radially outward from the spindle 60 relative to an axis of rotation of the spindle 60, a boss 64, and at least one gusset 66 corresponding to each of the arms 62. In the illustrated example, the rotor arms 62 are evenly spaced around the spindle 60 with approximately 120 degrees between a center line of adjacent arms 62. The arms 62 are also located in a common plane such that the arms rotate around the axis R in the common plane. The arms 62 may be formed from a single unitary piece of material, such as aluminum or steel, or formed separately and joined together to form a single rigid component through welding or mechanical fasteners. The arms 62 are planar as opposed to the generally round arms found troweling machines in the prior art that also pivot about a longitudinal axis of the arm. The arms 62 include an upper surface 62A adjacent the spindle 60 and a lower surface 62B adjacent flexible tool heads 72.

In the illustrated example, the spindle 60, the boss 64, and the gussets 66 are separately formed and fixedly attached together through a welding process. A proximal end of the spindle 60 is welded to the boss 64 and the gussets 66 are welded to both the spindle 60 and the boss 64. The spindle 60, the boss 64, and the gussets 66 are then removably attached to the arms 62 with fasteners 67, such as bolts or screws, in at least one of the boss 64 or the gussets 66. One feature of this arrangement is the ability to replace the arms 62 if they become damaged during operation without having to also replace the spindle 60, the boss 64, and the gussets 66. Also, this configuration distributes loads on the spindle 60 along greater portions of the arms 62 instead of directly at the base of the spindle 60.

The shaft 46 is accepted within a central opening in the spindle 60 and rotatably locks through a keyed connection 69 with one of the spindle 60 and the shaft 46 having a projection and the other of the spindle and the shaft 46 having a corresponding recess. A fastener 70 (FIG. 3) extends vertically through the arms 62, the boss 64, and the spindle 60 to threadably engage the shaft 46 and secure the rotor 28 to the shaft 46.

Figure 8:
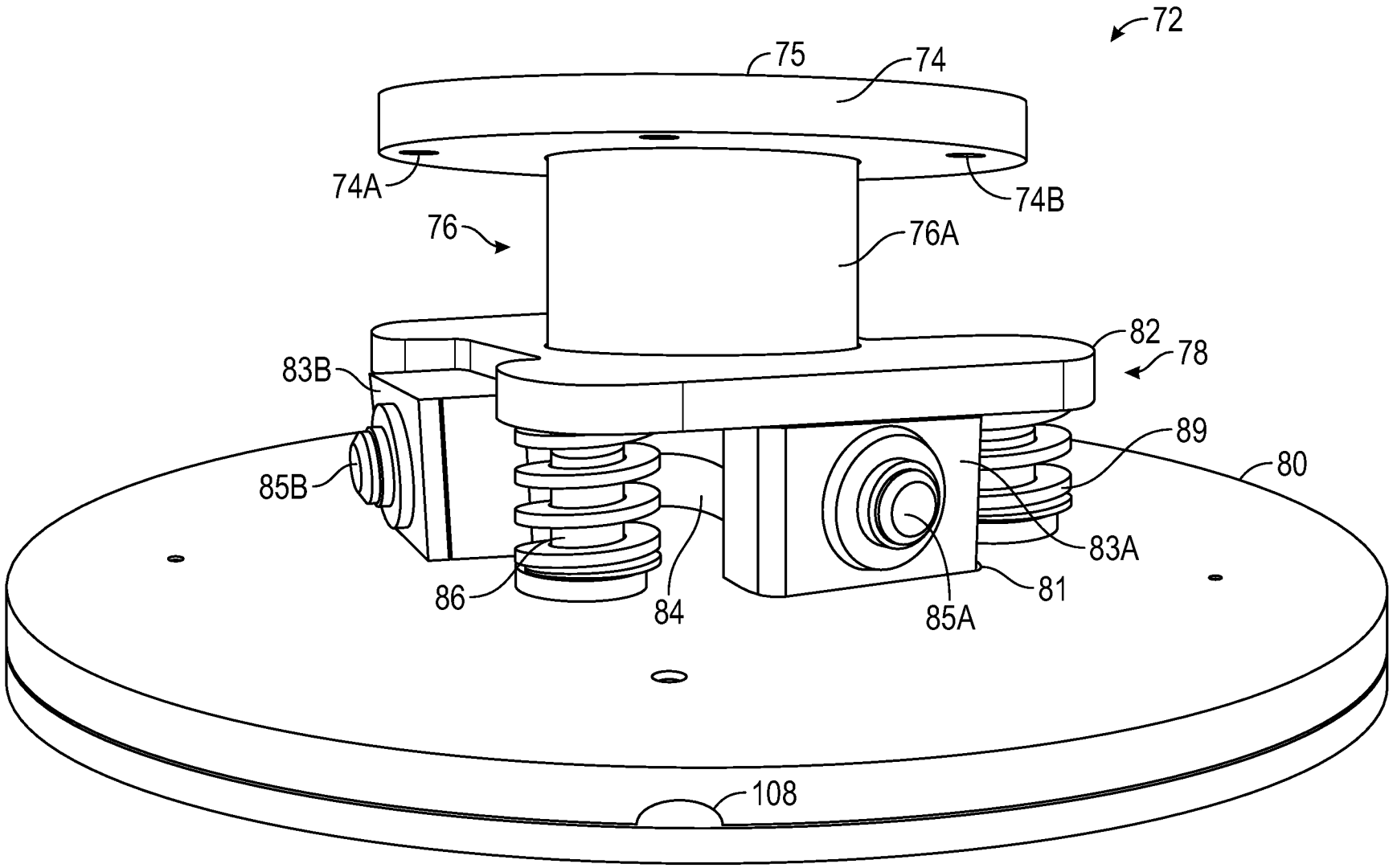
FIG. 8 illustrates a perspective view of a flexible tool head.
Figure 9A:
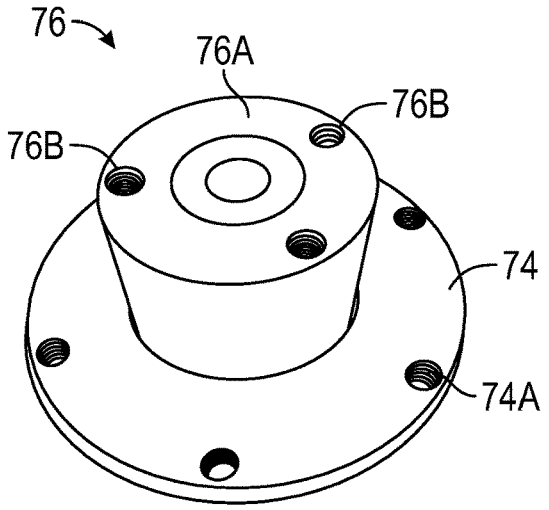
FIG. 9A illustrates a perspective view of an example bearing assembly with an example arm mounting plate.
Figure 9B:
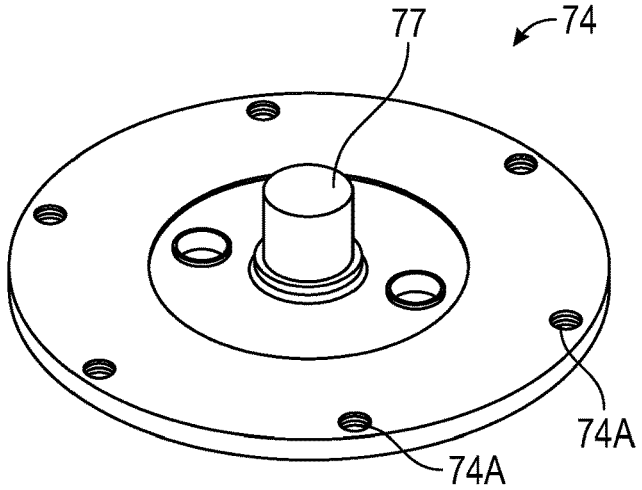
FIG. 9B illustrates a perspective view of the arm mounting plate of the flexible tool head of FIG. 8.
Figure 9C:
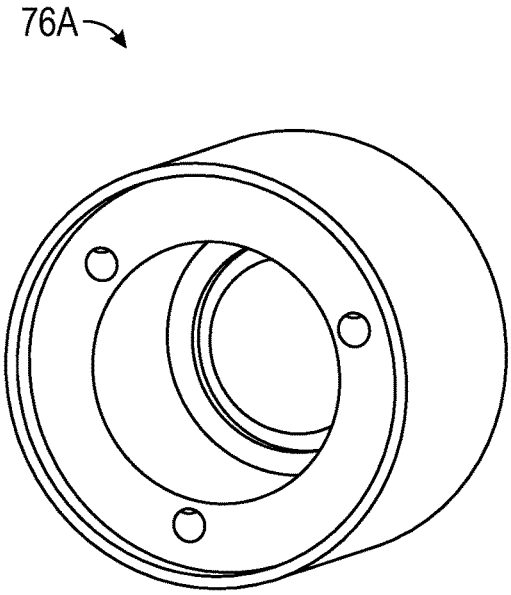
FIG. 9C illustrates a perspective view of an example outer housing for a bearing assembly.
Figure 9D:
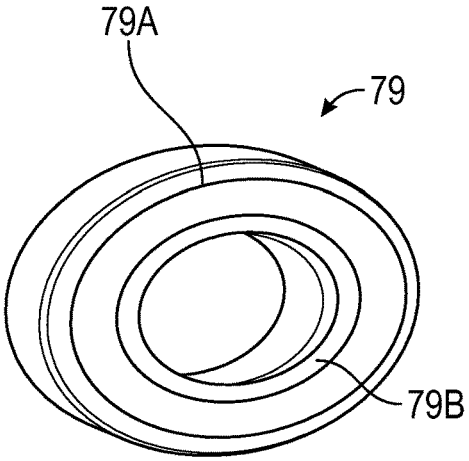
FIG. 9D illustrates an example bearing for the bearing assembly of FIG. 9A.
Figure 10A:
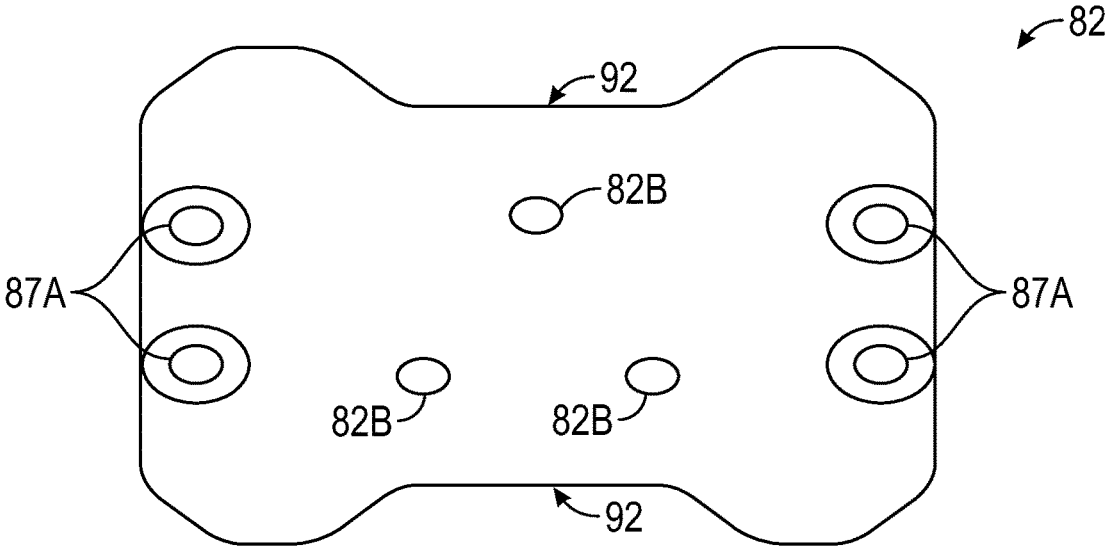
FIG. 10A illustrates a top view of an example intermediate plate of the flexible tool head of FIG. 8.
Figure 10B:
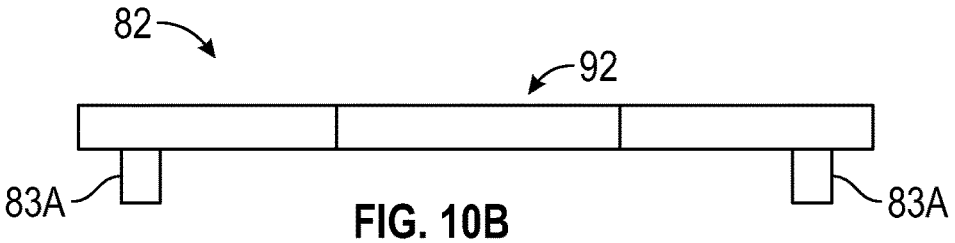
FIG. 10B illustrates a side view of the intermediate plate of FIG. 10A with tabs.
Figure 11:
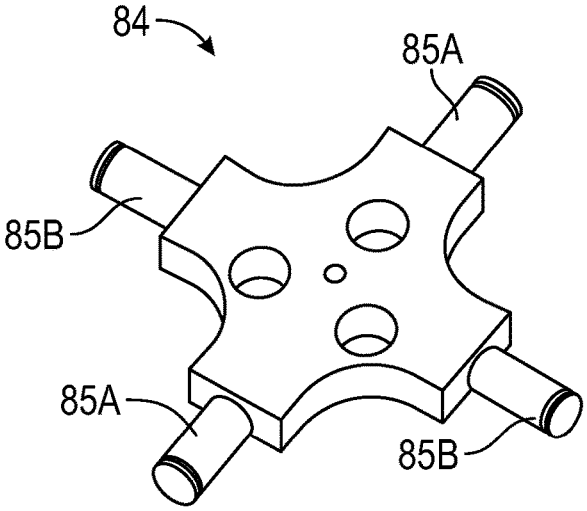
FIG. 11 illustrates a perspective view of an example cross-member of the flexible tool head of FIG. 8.
Figure 12:
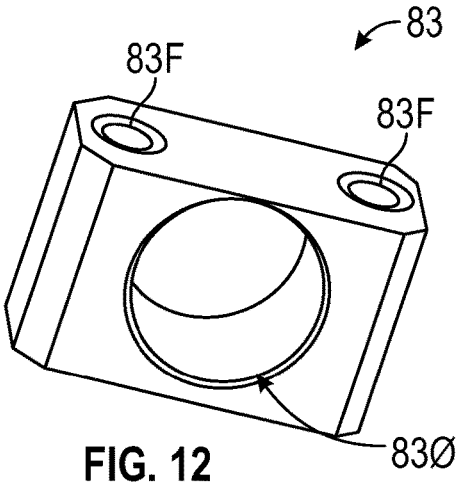
FIG. 12 illustrates an example tab for engaging the cross-member.
Figure 13:
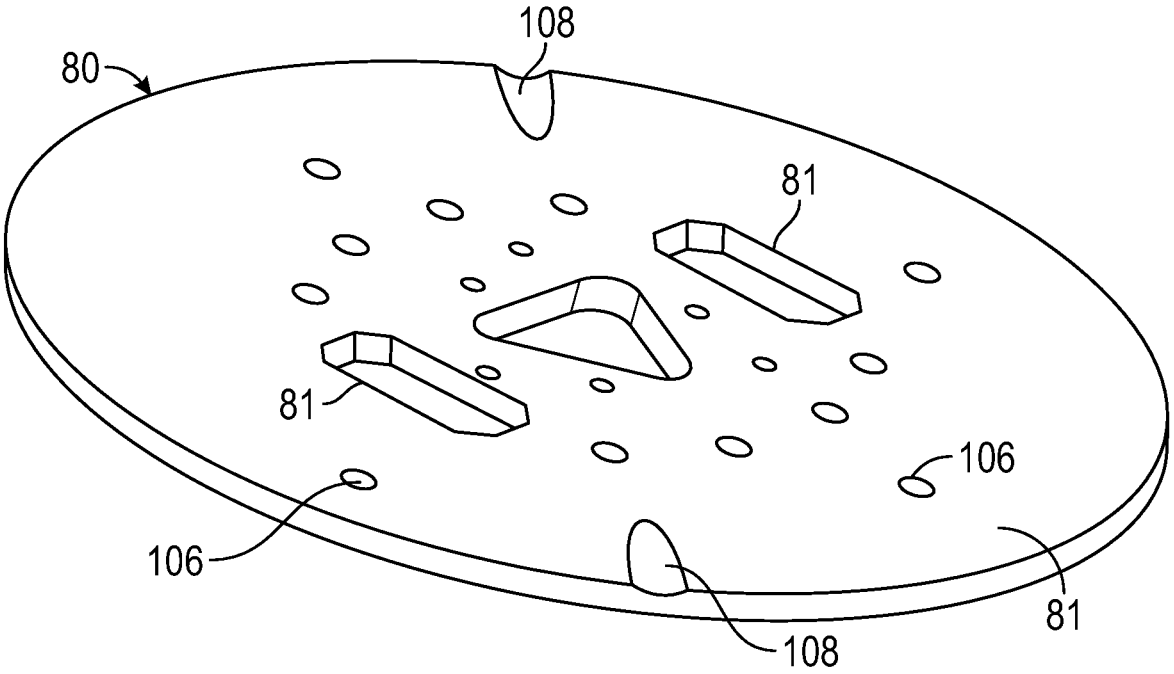
FIG. 13 illustrates a bottom view of an example mounting plate of the flexible tool head of FIG. 8.
Figure 14:
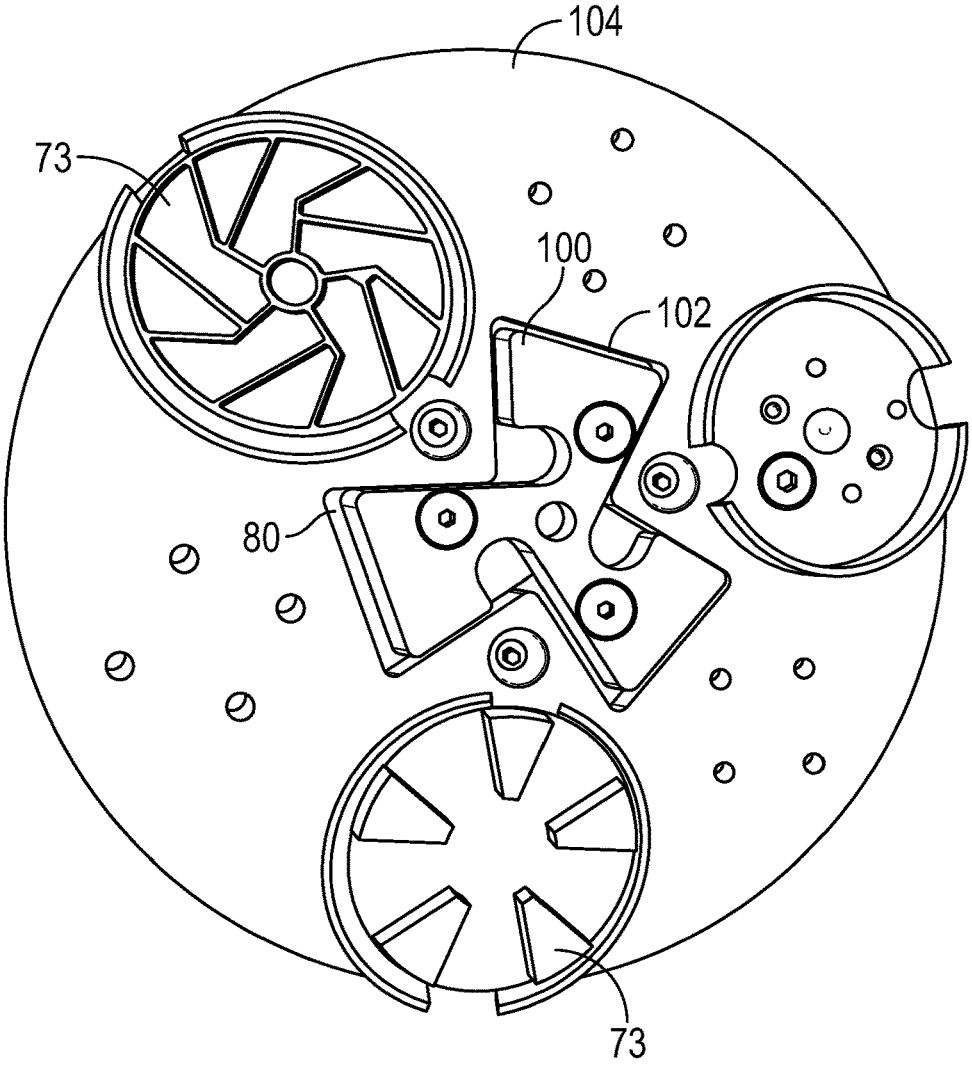
FIG. 14 illustrates a bottom view of a grinding plate.

As shown in FIGS. 7-14, the flexible tool heads 72 are attached adjacent distal end of the arms 62 for engaging the floor surface 22 with at least one tool 73 (FIGS. 3 and 14). In the illustrated example, each of the flexible tool heads 72 includes an arm mounting plate 74, a bearing assembly 76, an intermediate plate 82, and a flex portion 78 for allowing movement of a mounting plate 80 of an axis of the bearing assembly 76. The arm mounting plate 74 is a circular plate with an arm contact surface 75 for directly contacting the arm 62 and includes a shaft 77 for accepting a bearing 79 or a pair of bearings 79 spaced along the shaft 77 (FIGS. 8-9D). The shaft 77 also includes a shoulder for keeping the bearings 79 spaced from the arm mounting plate 74. The bearings 79 are also sealed bearings. The arm mounting plate 74 includes multiple fastener openings 74A that correspond with the fastener openings 63 (FIG. 6) in one of the arms 62 for accepting the fasteners 65.

The bearing assembly 76 includes an outer housing 76A mechanically connected relative to the arm mounting plate 74 through the at least one bearing 79. An outer race 79A of the at least one bearing 79 is fixed relative to an inner diameter of the outer housing 76A and an inner race 76B is fixed to the shaft 78 on the arm mounting plate 74. The outer housing 76A reduces or eliminates exposure of the bearings 79 to slurry or airborne debris in the enclosure 40 because a proximal end of the outer housing 76A is in close proximity to the arm mounting plate 74. The outer housing 76A also includes fastener openings 76B that correspond with openings 82B in the intermediate plate 82 for accepting fasteners for securing the outer housing 76A to the intermediate plate 82.

Figure 22:
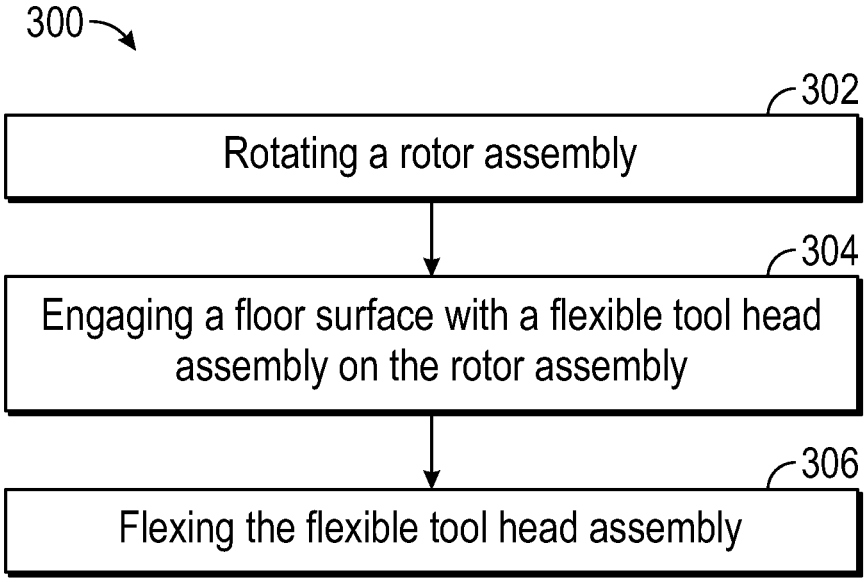
FIG. 22 illustrates an example method operating a rotor assembly.

FIG. 22 illustrates a method 300 of operating the rotors 28A, 28B with the flexible tool heads 72. When the rotor arms 28A, 28B are rotating (Block 302), one feature of the bearing assembly 76 is the ability to passively rotate the mounting plate 80 relative to the arm mounting plate 74 on the bearing assembly 76. (Block 304).

Additionally, the flex portion 78 allows a plane defined by the arm mounting plate 74 and a plane defined by the mounting plate 80 to move between a parallel orientation and a transverse orientation. This allows the mounting plate 80 to follow a contour of the floor surface 22 and not embed an edge of a tool 73 into the floor surface 22. In the illustrated example, this function is performed by the linking between the intermediate plate 82 and the mounting plate 80 with the flex portion 78.

The flex portion 78 allows for spring loaded movement of the mounting plate 80 relative to the intermediate plate 82 (FIGS. 8 and 10) and the bearing assembly 76. In particular, a rotational axis MA of the mounting plate 80 can move into and out of a colinear relationship with a rotational axis BA of the bearing assembly 76 depending on a contour of the floor surface 22 or a change in movement of the rotational axis R of one of the rotors 28A, 28B as illustrate in FIG. 7. (Block 306).

The flex portion 78 includes a cross member 84 (FIG. 11) having a first pair of opposing attachment posts 85A for engaging tabs 83A attached to the intermediate plate 82 with fasteners at tab openings 87A (FIG. 10). A second pair of opposing attachment posts 85B on the cross member 84 engage tabs 83B attached to the mounting plate 80 at tab fastener openings 87B. The tabs 83 (FIG. 12) are removably attached to a corresponding one of the intermediate plate 82 or the mounting plate 80 with fasteners and include a central opening 83Ø for accepting a corresponding one of the attachment posts 85A, 85B. Additionally, the tabs 83 include fastener openings 83F that expend perpendicular to the central opening 83Ø for accepting a fastener to secure the tabs 83 to one of the intermediate plate 82 or the mounting plate 80.

One of the mounting plate 80 or the intermediate plate 82 includes posts 86 surrounding by springs 89. The posts 86 function as retention guides for the springs 89. The posts 86 extend less than a distance between the mounting plate 80 and the intermediate plate 82 to act a stops to prevent over flexing between the intermediate plate 82 and the mounting plate 80.

The tabs 83A on the intermediate plate 82 are allowed to move through open region 81 of the mounting plate 80 during flexing of the intermediate plate 82 relative to the mounting plate 80. Similarly, tabs 83B on the mounting plate 80 move between opposing dog bone ends forming a tab openings 92 (FIGS. 10A-10B) in the intermediate plate 82 during flexing of the flex portion 78.

As shown in FIGS. 13-14, the mounting plate 80 includes a key 100 extending from grinder plate attachment surface 81 on the mounting plate 80 for mating with a keyed opening 102 in a grinding plate 104. The keyed opening 102 follows the same profile as the key 100 with a slightly larger size to allow for the key 100 to fit within the key opening 102 to prevent or limit rotational movement between the mounting plate 80 and the grinding plate 104.

Figure 15:
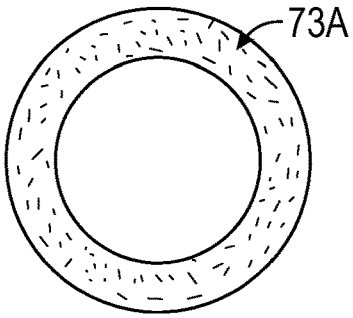
FIG. 15 illustrates a bristled pad.
Figure 16:
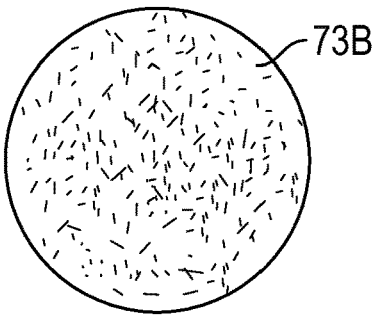
FIG. 16 illustrates a sand paper tool.

The mounting plate 80 also includes magnets 106 embedded in the surface of the mounting plate 80 that allow for quick and secure attachment of the grinding plate 104 to the mounting plate 80 without the need for additional fasteners. The mounting plate 80 also includes cut outs 108 that are recessed into a surface of the mounting plate 80 to allow a tool, such as a straight screw driver, to provide mechanical leverage to separate the mounting plate 80 from the grinding plate 104. In the case of the floor surface 22 being wood, the tools 73 include a sand paper finish 73B (FIG. 16) for gently engaging the floor surface 22 and in the case of a VCT floors a bristled brush surface 73A (FIG. 15) for accepting a scrubbing pad.

The grinding plate 104 also includes tools 73 (FIG. 14), such as resin based, carbide based, or diamond based tools, for engaging the floor surface 22. In the illustrates example, each of the tools 73 provide up to 90 lbs. of contact force or more against the floor surface 22. In the case of cementitious floor surfaces 22, the grinding plate 104 can include multiples of three tools 73, such as six, nine, or another multiple of three. Having multiples of three tools 73 on the grinding plate 104 contributes to the flatness and smoothness of the floor surface 22.

As shown in FIGS. 2 and 17, when machine 20 is operating, the rotors 28A and 28B are rotating in the rotational directions R1 (clockwise) and R2 (counter-clockwise), respectively. While the rotors 28A, 28B are rotating at a sufficient rotational speed, the machine 20 hovers on the floor surface 22 in a generally constant location with the rotational axes RA and RB perpendicular to the floor surface 22. Because the machine 20 hovers and does not move across the floor surface 22 supported on wheels, the machine 20 manipulates the rotational axes RA, RB relative to the floor surface 22 to maneuver the machine 20. This creates a location of greater contact force on the floor surface 22 leading the machine 20 to move in a desired directed.

The first rotor 28A is pivoted by a first actuator 96A1 about an axis PA1 and by a second actuator 96A2 about an axis PA2. The axes PA1 and PA2 are generally parallel to the floor surface 22 and perpendicular to each other when the machine 20 is stationary. The second rotor 28B is pivoted by a third actuator 96B1 about an axis PB1. The machine 20 can move in lateral directions L1 or L2 by pivoting the first rotator 28A about the axis PA2 with the second actuator 96A2 while the rotational axis RB remains generally perpendicular to the floor surface 22. The side of the machine 20 having the first rotor 28A can move forward or backwards by pivoting the rotational axis RA about the pivot axis PA1 with the first actuator 96A1. The right side of the machine 20 having the second rotor 28B can move forward or backwards by pivoting the rotational axis RB about the pivot axis PB1.

Figure 21:
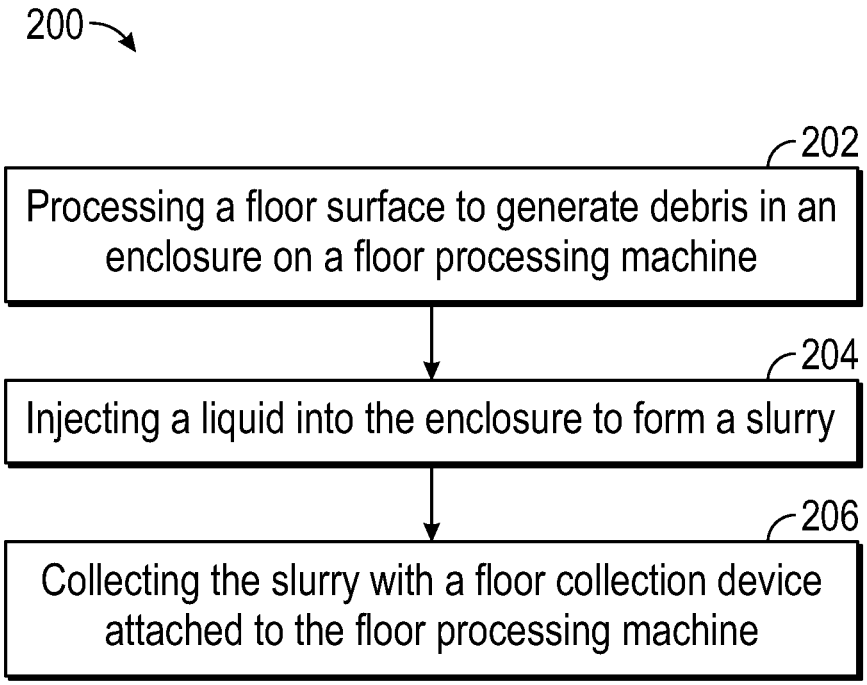
FIG. 21 illustrates an example method of operating the floor processing machine.

FIG. 21 illustrates an example method 200 of operating the machine 20. The machine 20 can operate in both dry conditions or wet conditions to generate debris within the enclosure (Block 202). For example, when used in dry conditions, the first and second rotors 28A and 28B can produce airborne particles, such as silica dust or wood fibers. The enclosure 40 includes a vacuum port 110 (FIG. 3) that can evacuate the particles by creating negative pressure within the enclosure 40. This is accomplished through a combination of the pan 34, the shroud 36, the skirt 38, and the boot 48, as described above. In particular, the skirt 38 is suspended on a suspension 39, such as a bungie or a cord, to allow the skirt 38 to move relative to the shroud 36 and engage the floor surface 22 to create a seal between the skirt 38 and the floor surface 22.

Additionally, the machine 20 includes a single quick connect vacuum port 90 (FIG. 2) fixed relative to the frame 24 and in communication (dashed lines represent a fluid connection) with a valve body 134. The valve body 134 is in electrical communication with the controller 29 and directs suction on the machine 20 without having to change connections based on the operation. The vacuum port 90 also allows for rotation of a vacuum hose 152 relative to the vacuum port 90 to prevent damaging the vacuum hose 152.

Figure 19:
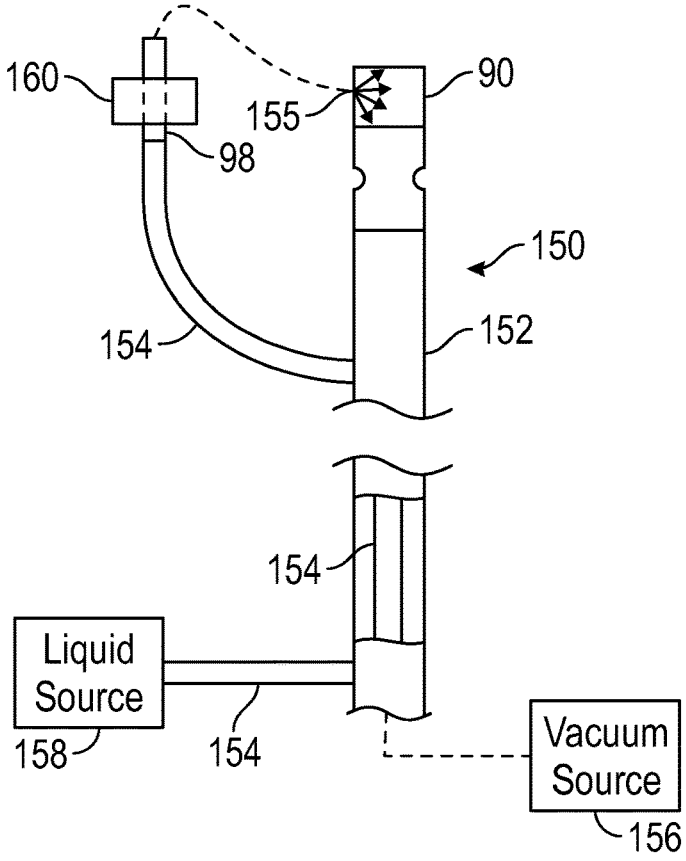
FIG. 19 illustrates an example wet-line assembly.

Additionally, when operating in dry conditions, the machine 20 can be used with a wet line 150 as shown in FIG. 19. The wet line 150 allows water to be injected into the vacuum hose 152 to turn the airborne particles into a slurry to improve management of the debris. In the illustrated example, wet line 150 includes the vacuum hose 152 that defines a perimeter of the vacuum line with a water line 154 running through a center of the vacuum hose 152. The water line 154 then protruding from a side of the vacuum hose 152 prior to the vacuum hose 152 connecting to the vacuum port 90. The water line 154 can then be attached to the machine 20 at water connector 98 and have the water sprayed into the vacuum port 90 through a nozzle 155 to mix with the debris and form the slurry.

Figure 20:
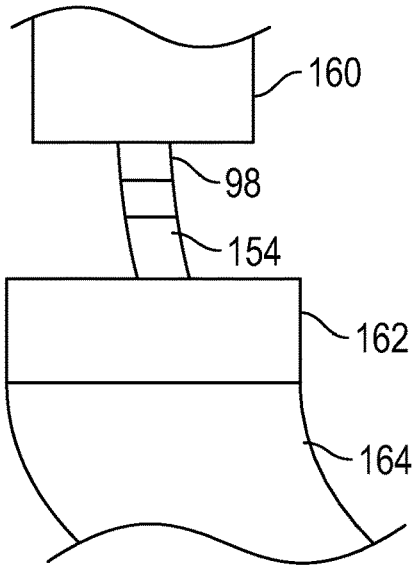
FIG. 20 illustrates an example water line connection.

Additionally, the water line 154 can be connected to the machine 20 without passing through the vacuum hose 152 as shown in FIG. 20. The water line 154 may also be surrounded by an outer hose 164 of greater diameter to prevent the water line 154 from kinking or going under the skirt 38. Additionally, the outer hose 164 may include a connection 162 that attaches to a rotatable quick connect 160 on the machine 20 to allow the outer hose 164 to rotate relative to the quick connect 160 on the machine 20.

When the machine 20 is operating in wet conditions on the floor surface 22, the vacuum port 110 to the pan 34 is not used to evacuate the enclosure 40. Liquid is provided to the enclosure 40 with a series of nozzles 112 in fluid communication a liquid source 158 through the water line 154 to spray a liquid, such as water, into the enclosure 40. (Block 204). The nozzles 112 are fluidly connected to the water line 154 through a liquid line 113. The addition of the liquid serves to capture the particles in the enclosure 40 and leads to the formation of a slurry on the floor surface 22.

As the machine 20 moves in lateral directions L1 and L2 (FIG. 17) during operation to ensure complete coverage by the rotors 28A, 28B on the floor surface 22, liquid from the nozzles 112 is sprayed on the floor surface 22. The nozzles 112 direct the liquid at the lateral sides of the enclosure 40 to wet the floor surface 22 prior to reaching the first and second rotors 28A, 28B. Nozzles 112 also spray the liquid near a center of rotation of the rotors 28A, 28B to further capture the airborne particles. Additionally, the nozzles 112 spray liquid between the first and second rotors 28A to clean the floor surface 22 of debris build up prior to the next rotor 28 reaching that portion of the floor surface 22.

When engaging a cementitious floor surface 22, the nozzles 112 spray water into a central region of the rotors 28A, 28B. This allows the formation of any dust or silica particles to be captured before spreading in the air. By adding water to the airborne particles, a material called a slurry is formed with very fine particles of cement suspended in the liquid. Because the slurry material is heavy from the weigh to the particles, it remains on the floor surface 22 as the machine 20 moves on the floor surface 22.

As shown in FIG. 2, the machine 20 includes floor collection devices, such as a first squeegee 120A located adjacent a first lateral edge of the frame 24 and a second squeegee 120B located adjacent a second lateral edge of the frame 24 opposite the first lateral edge, to aid in collecting slurry 130 form the floor surface 22. (Block 206). The floor collection devices can also include a vacuum line 132A, 132B to collect debris. The first and second squeegees 120A, 120B each include a frame 121A, 121B supporting a flexible portion 123A, 123B that follows a curvilinear profile (FIG. 18) and engages the floor surface 22 to scrape debris or slurry 130 off of the floor surface 22. The squeegees 120A, 120B are attached to the frame 24 by linkages 122A, 122B, respectively, that are part of a four-bar linkage. One portion of the four-bar linkages is formed by the frame 24, another portion is formed by the frame 121A, 121B, and the last two portions are formed by linkages 122A, 122B that are pivotably connected at opposing ends to the frame 121A, 121B, respectively, and the frame 24.

An actuators 124 is located adjacent each lateral side of the machine 20 and include a cable linkage 126, such as a throttle cable, that travels over a rotatable guide 128 attached to the frame 24 to connect to a corresponding one of the squeegees 120A, 120B to raise and lower the squeegees 120A, 120B depending on the mode of operation of the machine 20. Additionally, the operation of the separate actuators 124 can be combined and be performed by a single actuator if desired. For example, the actuators 124 can raise the squeegee 120A when it is located upstream relative to a direction of motion of the machine 20 and lower the squeegee 120B on the downstream side of the machine 20 to collect the debris or slurry 130 as it collects on the floor surface 22. When the squeegees 120A, 120B are lowered, it collects the debris or slurry into a central region of the squeegee 120A, 120B so that it can be collected by a vacuum line 132A, 132B (FIG. 18) also attached to the machine 20.

In the illustrated example, the vacuum lines 132A, 132B are attached to the valve body 134 that can selectively provide suction to various portions of the machine 20. In particular, the valve body 134 includes an input line 1321 from the vacuum port 90 attached to the frame 24. The valve body 134 can then fluidly connect the suction from the input suction line 1321 with either of the vacuum lines 132A, 132B or an enclosure suction line 132E that is connected with the vacuum port 110 on the pan 34.

Although the different non-limiting examples are illustrated as having specific components, the examples of this disclosure are not limited to those particular combinations. It is possible to use some of the components or features from any of the non-limiting examples in combination with features or components from any of the other non-limiting examples.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. An assembly for a floor surface processing machine comprising:

at least one rotor including a floor tool engagement surface;

a frame at least partially surrounding the at least one rotor; and an enclosure at least partially surrounding the at least one rotor and fixed relative to the frame, the enclosure comprising:

a pan including at least one shaft opening for accepting a drive shaft for the at least one rotor;

a shroud at least partially surrounding the pan and extending transversely relative to the pan; and a skirt surrounding a perimeter of the shroud and moveable relative to the shroud to adjust a height of the skirt relative to the shroud.

2. The assembly of claim 1, including a water line fitting surrounded by and spaced from a rotatable outer hose connection, wherein the rotatable outer hose connection includes a diameter larger than a diameter of the water line fitting and the rotatable outer hose connection defines an outer portion of a vacuum line.

3. The assembly of claim 1, wherein an intersection of the shroud and the pan forms a sealed connection with a first lateral side of the shroud facing the at least one rotor and a second lateral side of the shroud opposite the first lateral side abutting a lateral side of the skirt, and the skirt is supported relative to the shroud by a suspension.

4. The assembly of claim 1, wherein the pan extends in a plane generally parallel with a plane of a floor surface.

5. The assembly of claim 4, including a flexible boot at least partially enclosing the at least one shaft opening in the pan with the flexible boot having a drive shaft opening for accepting the drive shaft.

6. The assembly of claim 5, including a first bearing engaging a first side of the flexible boot, wherein the first bearing includes an outer race fixed relative to the flexible boot and an inner race configured to rotate with the drive shaft to form a seal with the drive shaft.

7. The assembly of claim 6, including a second bearing engaging a second side of the flexible boot relative to an axis of rotation of the drive shaft, wherein the second bearing includes an outer race fixed relative to the flexible boot and an inner race configured to rotate with the drive shaft.

8. The assembly of claim 1, wherein the frame supports an operator seat, the skirt overlaps the shroud on an outer side of the enclosure, a distal edge of the shroud is configured to define a passage with a floor surface, the skirt is configured to overlap the passage, and the distal edge of the shroud is located closer to a floor surface than the at least one rotor.

9. The assembly of claim 1, wherein the at least one rotor includes a first rotor and a second rotor with a first motor in driving engagement with the first rotor through a first drive shaft and a second motor in driving engagement with the second rotor through a second drive shaft and the first motor and the first rotor both rotate about a first rotational axis and the second motor and the second rotor both rotate about a second rotational axis spaced from the first rotational axis.

10. The assembly of claim 9, wherein the first rotor includes a plurality of arms rigidly fixed to a first central hub and the second rotor includes a second plurality of arms rigidly fixed to a second central hub.

11. The assembly of claim 3, wherein the suspension includes one of a bungie or a cord.

12. The assembly of claim 5, wherein the flexible boot includes a bellows having at least one undulation.

13. An assembly for a floor surface processing machine comprising:

a first rotor including at least one floor tool attachment surface;

a second rotor including at least one floor tool attachment surface;

a frame at least partially surrounding the first rotor and the second rotor; and an enclosure at least partially surrounding the first rotor and the second rotor and fixed relative to the frame, the enclosure comprising:

a pan including a first opening for accepting a first rotor drive shaft and a second opening for accepting a second rotor drive shaft;

a shroud at least partially surrounding the pan and extending transversely relative to the pan; and a skirt surrounding a perimeter of the shroud and moveable relative to the shroud to adjust a height of the skirt relative to the shroud.

14. The assembly of claim 13, wherein the first rotor includes a first plurality of arms extending from a first central hub with each of the first plurality of arms on the first rotor including one of the at least one floor tool attachment surface and the second rotor includes a second plurality of arms extending from a second central hub with each of the second plurality of arms on the second rotor including one of the at least one floor tool attachment surface.

15. The assembly of claim 14, wherein the first plurality of arms on the first rotor are each rigidly attached to the first central hub and the second plurality of arms on the second rotor are rigidly attached to the second central hub.

16. The assembly of claim 13, wherein the frame supports an operator seat, the skirt overlaps the shroud on an outer side of the enclosure, a distal edge of the shroud is configured to define a passage with a floor surface, the skirt is configured to overlap the passage, and the distal edge of the shroud is located closer to a floor surface than the first or second rotors.

17. The assembly of claim 13, including a first motor for driving the first rotor through the first rotor drive shaft and a second motor for driving the second rotor through the second rotor drive shaft and the enclosure includes a plurality of nozzles in fluid communication with a water line.

18. The assembly of claim 17, wherein the first motor and the first rotor both rotate about a first rotational axis and the second motor and the second rotor both rotate about a second rotational axis spaced from the first rotational axis.

19. The assembly of claim 18, wherein the first rotational axis and the second rotational axis are pivotable relative to the pan.

20. The assembly of claim 19, wherein an intersection of the shroud and the pan forms a sealed connection with a first lateral side of the shroud facing the first and second rotors and a second lateral side of the shroud opposite the first lateral side abutting a lateral side of the skirt, the skirt is supported relative to the shroud by a suspension, and a first flexible boot engages the pan and forms a seal with the first rotor drive shaft and a second flexible boot engaging the pan and forms a seal with the second rotor drive shaft.

21. The assembly of claim 20, including a first pair of bearings each including an outer race fixed relative to the first flexible boot and an inner race fixed relative to the first rotor drive shaft and a second pair of bearings each including an outer race fixed relative to the second flexible boot and an inner race fixed relative to the second rotor drive shaft.

* * * * *